US006769959B2

(12) United States Patent
Chen et al.

(10) Patent No.: US 6,769,959 B2
(45) Date of Patent: Aug. 3, 2004

(54) METHOD AND SYSTEM FOR SLURRY USAGE REDUCTION IN CHEMICAL MECHANICAL POLISHING

(75) Inventors: Kei-Wei Chen, Yung-Ho (TW); Ting-Chun Wang, Taoyuan (TW); Shih-Tzung Chang, Fengyuan Taichung (TW); Yu-Ku Lin, Hsin-chu (TW); Ying-Lang Wang, Tien-Chung (TW); Ming-Wen Chen, Taipei (TW); Kuo-Hsiu Wei, Banchiau (TW)

(73) Assignee: Taiwan Semiconductor Manufacturing Co., Ltd, Hsin Chu (TW)

( * ) Notice: Subject to any disclaimer, the term of this patent is extended or adjusted under 35 U.S.C. 154(b) by 208 days.

(21) Appl. No.: 10/050,314

(22) Filed: Jan. 15, 2002

(65) Prior Publication Data

US 2003/0143924 A1 Jul. 31, 2003

(51) Int. Cl.[7] ..... B24B 1/00

(52) U.S. Cl. ..... 451/8; 451/36; 451/41; 451/285; 451/446

(58) Field of Search ..... 451/41, 36, 446, 451/285, 287, 10, 7, 8, 9

(56) References Cited

U.S. PATENT DOCUMENTS 6,283,840 B1 * 9/2001 Huey ..... 451/288
6,398,906 B1 * 6/2002 Kobayashi et al. .... 156/345.12
6,527,624 B1 * 3/2003 Tolles et al. ..... 451/41

* cited by examiner

*Primary Examiner*—Eileen P. Morgan
(74) *Attorney, Agent, or Firm*—Tung & Associates

(57) ABSTRACT

A method and system is disclosed for reducing slurry usage in a chemical mechanical polishing operation utilizing at least one polishing pad thereof. Slurry can be intermittently supplied to a chemical mechanical polishing device. The slurry is generally flushed so that a portion of said slurry is trapped in a plurality of pores of at least one polishing pad associated with said chemical mechanical polishing device, wherein only a minimum amount of said slurry necessary is utilized to perform said chemical mechanical polishing operation, thereby reducing slurry usage and maintaining a consistent level of slurry removal rate performance and a decrease in particle defects thereof. The present invention thus discloses a method and system for intermittently delivering slurry to a chemical mechanical polishing device in a manner that significantly conserves slurry usage.

20 Claims, 2 Drawing Sheets

METHOD AND SYSTEM FOR SLURRY USAGE REDUCTION IN CHEMICAL MECHANICAL POLISHING

TECHNICAL FIELD

The present invention relates generally to semiconductor fabrication methods and systems. The present invention also generally relates to chemical mechanical polishing devices and techniques thereof. The present invention additionally relates to slurry delivery methods and systems. The present invention also relates to methods and systems for reducing slurry usage during chemical mechanical polishing operations.

BACKGROUND OF THE INVENTION

Integrated circuits are typically formed on substrates, particularly silicon wafers, by the sequential deposition of conductive, semiconductive or insulative layers. After each layer is deposited, the layer is etched to create circuitry features. As a series of layers are sequentially deposited and etched, the outer or uppermost surface of the substrate, i.e., the exposed surface of the substrate, becomes successively more non-planar. This occurs because the distance between the outer surface and the underlying substrate is greatest in regions of the substrate where the least etching has occurred, and least in regions where the greatest etching has occurred. With a single patterned underlying layer, this non-planar surface comprises a series of peaks and valleys wherein the distance between the highest peak and the lowest valley may be the order of 7000 to 10,000 Angstroms. With multiple patterned underlying layers, the height difference between the peaks and valleys becomes even more severe, and can reach several microns.

This non-planar outer surface presents a problem for the integrated circuit manufacturer. If the outer surface is non-planar, then photo lithographic techniques used to pattern photoresist layers might not be suitable, as a non-planar surface can prevent proper focusing of the photolithography apparatus. Therefore, there is a need to periodically planarize this substrate surface to provide a planar layer surface. Planarization, in effect, polishes away a non-planar, outer surface, whether conductive, semiconductive, or insulative, to form a relatively flat, smooth surface. Following planarization, additional layers may be deposited on the outer surface to form interconnect lines between features, or the outer surface may be etched to form vias to lower features.

Chemical mechanical polishing is one accepted method of planarization. This planarization method typically requires that the substrate be mounted on a carrier or polishing head, with the surface of the substrate to be polished exposed. The substrate is then placed against a rotating polishing pad. In addition, the carrier head may rotate to provide additional motion between the substrate and polishing surface. Further, a polishing slurry, including an abrasive and at least one chemically-reactive agent, may be spread on the polishing pad to provide an abrasive chemical solution at the interface between the pad and substrate.

Important factors in the chemical mechanical polishing process are: the finish (roughness) and flatness (lack of large scale topography) of the substrate surface, and the polishing rate. Inadequate flatness and finish can produce substrate defects. The polishing rate sets the time needed to polish a layer. Thus, it sets the maximum throughput of the polishing apparatus.

Each polishing pad provides a surface, which, in combination with the specific slurry mixture, can provide specific polishing characteristics. Thus, for any material being polished, the pad and slurry combination is theoretically capable of providing a specified finish and flatness on the polished surface. The pad and slurry combination can provide this finish and flatness in a specified polishing time. Additional factors, such as the relative speed between the substrate and pad, and the force pressing the substrate against the pad, affect the polishing rate, finish and flatness.

In some chemical mechanical polishing systems, the slurry flows continuously onto a flat polish table. As the table rotates, slurry is flung off the edge and carried away by a drain. This is wasteful of slurry material, leads to nonuniformity of the slurry at different locations, and splatters the abrasive slurry into surrounding machinery. Some prior art chemical mechanical polishing devices or systems includes a raised wall of rectangular cross-section surrounds the table's edge. Such a wall or containment device must form a liquid-tight seal around the entire periphery of the polish table. Yet, at the same time, the wall must be easily removable in order to clean the polish table periodically, and must be quickly reinstallable on the table for setting up the next run with a new batch of slurry.

FIG. 1 depicts a prior art diagram 10 illustrating the manner in which particle size increases the number of particles contacting a surface during chemical mechanical polishing operations. As depicted in FIG. 1, at high particle concentrations, when the particle fill factor is near unity, decreasing particle size increases the number of particles contacting the surface. FIG. 2, on the other hand, illustrates a prior art diagram 20 illustrating the manner in which decreasing particle size does not increase the number of particles contacting a surface during chemical mechanical polishing operations. As illustrated in diagram 20 of FIG. 2, at low abrasive concentrations, when the particle fill factor is much lass than unity, decreasing particle size does not increase the number of particles contacting the surface. FIG. 3 depicts a block diagram 30 of a prior art wafer, slurry, and pad configuration utilized in chemical mechanical polishing operations. Diagram 30 illustrates a wafer 32, a slurry 34, and a polishing pad 36. Thus, based on FIGS. 1 to 3, it can be appreciated that in prior art slurry delivery systems, a low continuous slurry flow rate affects the total removal rate. Additionally, a low continuous slurry flow rate induces high noise and can damage parts.

FIG. 4 illustrates a prior dam and polishing arrangement 40. The configuration illustrated in FIG. 4 is a type of device utilized to implement the apparatus disclosed in U.S. Pat. No. 5,299,393 to Chandler, et al, "Slurry Containment Device for Polishing Semiconductor Wafers." Chandler et al generally claims a containment device for the chemical-mechanical polishing of semiconductor wafers and similar workpieces. The device attempts to prevent the leakage of liquid slurry from a polish table. The device can be removed for cleaning and then reinstalled. The device contains a circular continuous band shaped to fit a polish table having a substantially circular periphery. Another circular continuous band of less stiff flexible material, capable of conforming closely to the table periphery, has a continuous, impermeable bond to the first band. A flexible clamp completely encircles the second band so as to force all of said inside surface of said second band tightly against the periphery of the table. The clamp has a release or latch for loosening said second band sufficiently to allow removal of the entire containment device from the table periphery. The device of Chandler et al, however, suffers from several disadvantages, including an unstable slurry concentration and removal rate, in addition to being unable to meet current and expected requirements for the reprocessing of slurry.

Traditional chemical mechanical polishing operations and devices and systems thereof, thus utilize continuous slurry delivery processes. The present inventors have concluded that such continuous slurry delivery techniques are costly and result in a high number of scratch defects. In addition, the present inventors have concluded that such slurry delivery techniques also suffer from low slurry removal rates and high polishing noise. Because the continuous slurry flow rate is proportional to the slurry removal rate, low removal rates are a significant factor affecting costs. Based on the foregoing, the present inventors have concluded that a need exists for a slurry delivery method and system which would avoid the aforementioned problems associated with prior art slurry delivery and chemical mechanical polishing systems, while reducing slurry usage, thereby conserving slurry and avoiding waste. The present inventors believe that the present invention described herein overcomes the problems associated with the prior art, while effectively reducing slurry usage and maintaining a consistent level of removal rate performance and fewer particle defects.

BRIEF SUMMARY OF THE INVENTION

The following summary of the invention is provided to facilitate an understanding of some of the innovative features unique to the present invention, and is not intended to be a full description. A full appreciation of the various aspects of the invention can be gained by taking the entire specification, claims, drawings, and abstract as a whole.

It is therefore one aspect of the present invention to provide an improved semiconductor fabrication method and system.

It is therefore another aspect of the present invention to provide an improved method and system for delivering a slurry utilized in a chemical mechanical polishing operation.

It is yet another aspect of the present invention to provide an intermittent slurry delivery method and system for reducing slurry usage thereof during chemical mechanical polishing operations.

It is still another aspect of the present invention to provide an intermittent slurry delivery method and system that can be implemented in the context of improved or retrofitted chemical mechanical polishing devices utilized in semiconductor fabrication processes.

The above and other aspects of the present invention can thus be achieved as is now described. A method and system is disclosed for reducing slurry usage in a chemical mechanical polishing operation utilizing at least one polishing pad thereof. Slurry can be intermittently supplied to a chemical mechanical polishing device. The slurry is generally flushed so that a portion of said slurry is trapped in a plurality of pores of at least one polishing pad associated with said chemical mechanical polishing device, wherein only a minimum amount of said slurry necessary is utilized to perform said chemical mechanical polishing operation, thereby reducing slurry usage and maintaining a consistent level of slurry removal rate performance and a decrease in particle defects thereof. The slurry can be automatically flushed utilizing a high pressure rinse arm associated with said chemical mechanical polishing device.

The temperature associated with said chemical mechanical polishing operation can be reduced while flushing said slurry so that said portion of said slurry is trapped in said plurality of pores of the polishing pad. The chemical mechanical polishing device can be configured or retrofitted to comprise a plurality of polishing elements that include one or more slurry arms that operate in association with one or more pressure sprayers integrated with one or more pad conditioners, one or more polishing heads, one or more platens and one or more cup head crosses. Additionally, the chemical mechanical polishing device can be configured or retrofitted, such that the aforementioned polishing elements can be automatically controlled utilizing a robot linked to said chemical mechanical polishing device. Such a robot is also linked to a cassette thereof.

The chemical mechanical polishing device, in accordance with a preferred embodiment of the present invention, generally includes one or more slurry tanks connected to one or more pumps. Additionally, the chemical mechanical polishing device can be configured or retrofitted to include a flow meter linked a nozzle and to the pump, such that the flow meter provides a feedback signal to the pump. The chemical mechanical polishing device also includes a controller linked to at least one flow meter. A feedback control loop can be initiated among the controller, the flow meter and the nozzle to assist in providing intermittent delivery of the slurry. The controller can include a valve. Multiple chemical mechanical polishing operations can be performed utilizing at least one diaphragm pump connected to said chemical mechanical polishing device.

BRIEF DESCRIPTION OF THE DRAWINGS

The accompanying figures, in which like reference numerals refer to identical or functionally-similar elements throughout the separate views and which are incorporated in and form part of the specification, further illustrate the present invention and, together with the detailed description of the invention, serve to explain the principles of the present invention.

DETAILED DESCRIPTION OF THE INVENTION

The particular values and configurations discussed in non-limiting examples can be varied and are cited merely to illustrate embodiments of the present invention and are not intended to limit the scope of the invention.

As indicated herein, traditional CMP polishing operations and devices and systems thereof, utilize continuous slurry delivery processes. Such continuous slurry delivery techniques are costly and result in a high number of scratch defects. In addition, such slurry delivery techniques also suffer from low slurry removal rates and high polishing noise. The present invention thus discloses a method and system for intermittently delivering slurry to a chemical mechanical polishing device in a manner that significantly conserves slurry usage.

Figure 1:
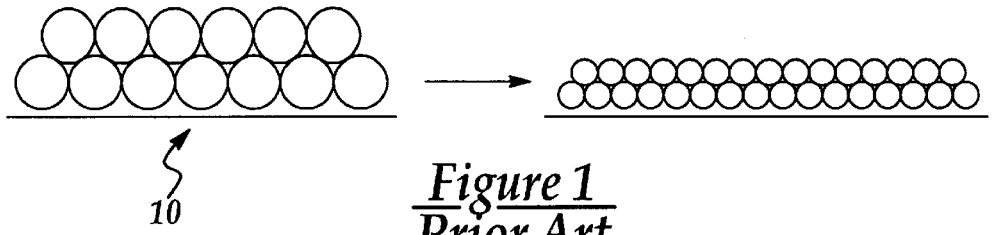
Figure 1 Prior Art
FIG. 1 depicts a prior art diagram illustrating the manner in which particle size increases the number of particles contacting a surface during chemical mechanical polishing operations.
Figure 2:
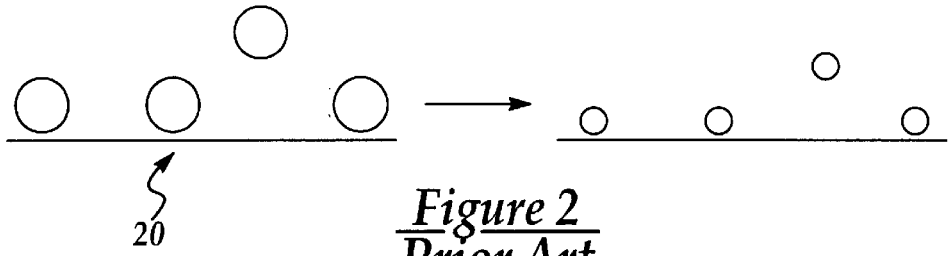
Figure 2 Prior Art
FIG. 2 illustrates a prior art diagram illustrating the manner in which decreasing particle size does not increase the number of particles contacting a surface during chemical mechanical polishing operations.
Figure 3:
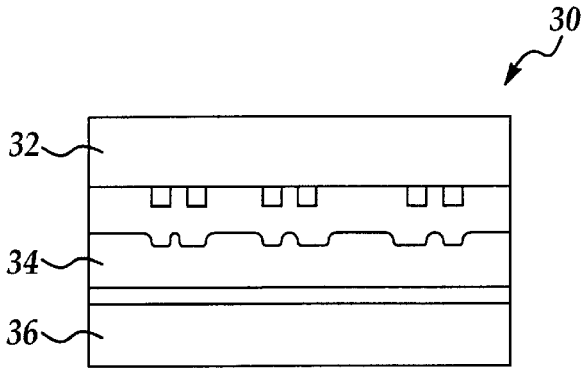
Figure 3 Prior Art
FIG. 3 depicts a block diagram of a prior art wafer, slurry, and pad configuration utilized in chemical mechanical polishing operations.
Figure 4:
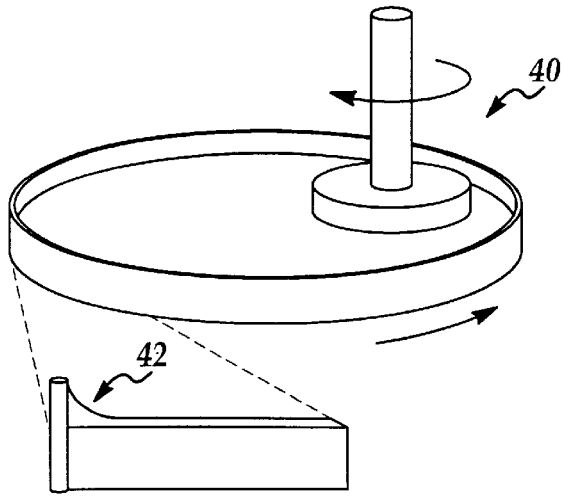
Figure 4 Prior Art
FIG. 4 illustrates a prior dam and polishing arrangement.
Figure 5:
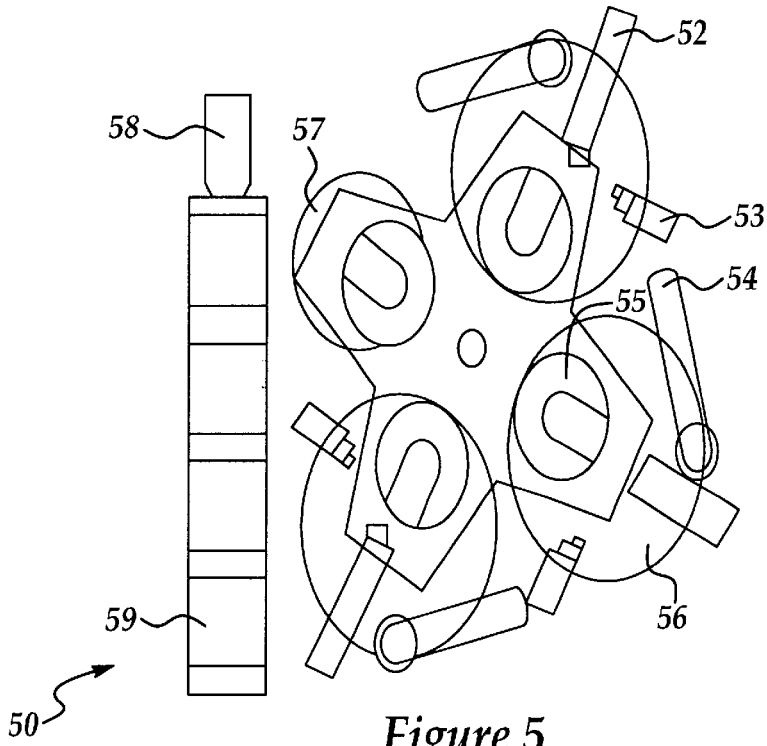
FIG. 5 depicts a block diagram of a hardware arrangement that can be implemented to retrofit a CMP device for slurry conservation, in accordance with a preferred embodiment of the present invention.

FIG. 5 depicts a block diagram 50 of a hardware arrangement that can be implemented to retrofit a CMP device for slurry conservation, in accordance with a preferred embodiment of the present invention. Such a hardware arrangement can be implemented in the context of improved slurry delivery systems and chemical mechanical polishing devices thereof or may retrofitted in association with older chemical mechanical polishing devices and systems. By utilizing the arrangement illustrated in FIG. 5, slurry usage in chemical mechanical polishing operations can be effectively reduced.

Thus, the hardware arrangement illustrated in FIG. 5 includes a slurry arm 52, an ultra pressure DIW sprayer 53, and a pad conditioner 54. Additionally, a polishing head 55 is illustrated, which operates in association with a rotary platen 56. A loading cup head cross 57 is generally located opposite rotary platen 56. Those skilled in the art can appreciate that although only one of each of the aforementioned polishing elements is referenced herein via appropriate reference numerals, one or more of each such elements can be implemented appropriately, in association with a chemical mechanical polishing device. A plurality of such polishing elements can thus be configured in association with a robot 58, which is connected to a cassette 59.

Ultra pressure DIW sprayer 53 generally can comprise an ultra high pressure rinse arm, which can be utilized in association with a temperature mechanism (i.e., not illustrated) to reduce the temperature and flush slurry compacted in a polishing pad grove. Mutli-polish step functions can then be supported by a diaphragm pump to intermittently control the delivery of slurry. An on-off slurry delivery mechanism can thus implemented in association with the diaphragm pump and multiple-step polishing functions to reduce slurry usage and maintain the same performance level of slurry removal rate and particle defects.

Figure 6:
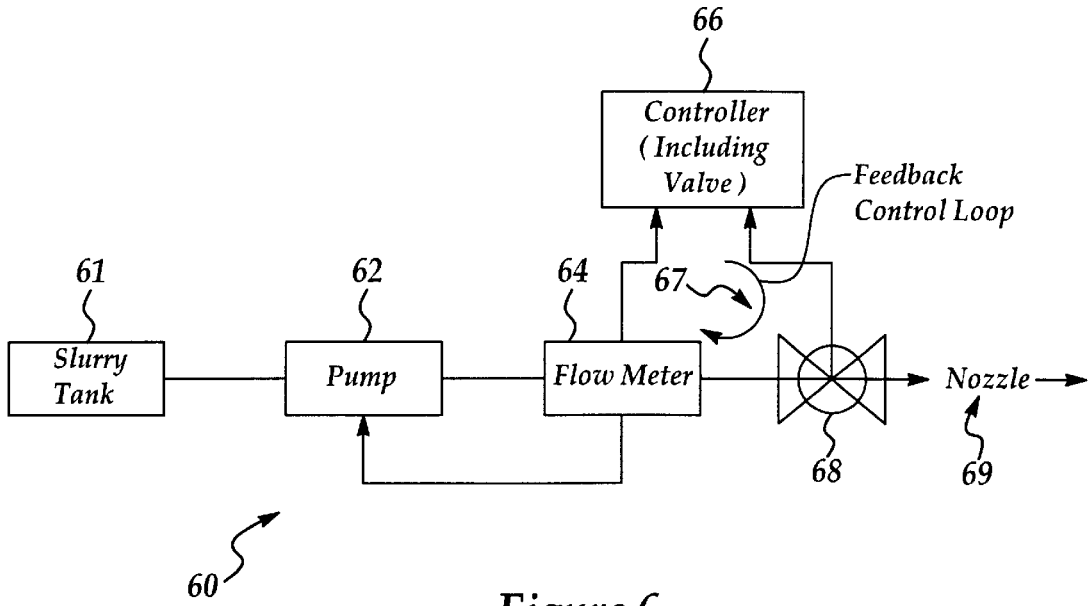
FIG. 6 illustrates a block diagram of a chemical mechanical polishing system 60 that can be implemented in accordance with a preferred embodiment of the present invention to reduce slurry usage and conserve slurry thereof.

FIG. 6 illustrates a block diagram of a chemical mechanical polishing system 60 that can be implemented in accordance with a preferred embodiment of the present invention to reduce slurry usage and conserve slurry thereof. System 60 generally includes a slurry tank 61 which is linked to a pump 62. Pump 62 can comprise a diaphragm pump. Pump 62 is in turn connected to a flow meter 64. Flow meter 62 is generally connected to a controller 62, which can include a valve. Controller 62 is linked to a valve 68. Valve 68 can comprise the valve included with controller 62 or may comprise a stand alone valve linked to controller 66. In any event, valve 68 is linked to flow meter 64. Valve 68 is also linked to a nozzle 69. A feedback control loop 67 can be initiated among flow meter 64, controller 66 and valve 68.

Based on the foregoing, it can be appreciated that the present invention thus discloses a method and system for reducing slurry usage in a chemical mechanical polishing operation utilizing at least one polishing pad thereof. Slurry can be intermittently supplied to a chemical mechanical polishing device. The slurry is generally flushed so that a portion of said slurry is trapped in a plurality of pores of at least one polishing pad associated with said chemical mechanical polishing device, wherein only a minimum amount of said slurry necessary is utilized to perform said chemical mechanical polishing operation, thereby reducing slurry usage and maintaining a consistent level of slurry removal rate performance and a decrease in particle defects thereof. The slurry can be automatically flushed utilizing a high pressure rinse arm associated with said chemical mechanical polishing device.

The temperature associated with said chemical mechanical polishing operation can be reduced while flushing said slurry so that said portion of said slurry is trapped in said plurality of pores of the polishing pad. The chemical mechanical polishing device can be configured or retrofitted to comprise a plurality of polishing elements that include one or more slurry arms that operate in association with one or more pressure sprayers integrated with one or more pad conditioners, one or more polishing heads, one or more platens and one or more cup head crosses. Additionally, the chemical mechanical polishing device can be configured or retrofitted, such that the aforementioned polishing elements can be automatically controlled utilizing a robot linked to said chemical mechanical polishing device. Such a robot is also linked to a cassette thereof.

The chemical mechanical polishing device, in accordance with a preferred embodiment of the present invention, generally includes one or more slurry tanks connected to one or more pumps. Additionally, the chemical mechanical polishing device can be configured or retrofitted to include a flow meter linked a nozzle and to the pump, such that the flow meter provides a feedback signal to the pump. The chemical mechanical polishing device also includes a controller linked to at least one flow meter. A feedback control loop can be initiated among the controller, the flow meter and the nozzle to assist in providing intermittent delivery of the slurry. The controller can include a valve. Multiple chemical mechanical polishing operations can be performed utilizing at least one diaphragm pump connected to said chemical mechanical polishing device The embodiments and examples set forth herein are presented to best explain the present invention and its practical application and to thereby enable those skilled in the art to make and utilize the invention. Those skilled in the art, however, will recognize that the foregoing description and examples have been presented for the purpose of illustration and example only. Other variations and modifications of the present invention will be apparent to those of skill in the art, and it is the intent of the appended claims that such variations and modifications be covered. The description as set forth is thus not intended to be exhaustive or to limit the scope of the invention. Many modifications and variations are possible in light of the above teaching without departing from scope of the following claims. It is contemplated that the use of the present invention can involve components having different characteristics. It is intended that the scope of the present invention be defined by the claims appended hereto, giving full cognizance to equivalents in all respects.

What is claimed is:

1. A method for reducing slurry usage in a chemical mechanical polishing operation utilizing at least one polishing pad thereof, said method comprising the steps of:

intermittently supplying slurry to a chemical mechanical polishing device; and flushing said slurry utilizing a sprayer so that a portion of said slurry is trapped in a plurality of pores of said at least one polishing pad associated with said chemical mechanical polishing device, wherein only a minimal amount of said slurry necessary is utilized to perform said chemical mechanical polishing operation, thereby reducing slurry usage and maintaining a consistent slurry removal rate.

2. The method of claim 1 wherein the step of flushing said slurry utilizing said sprayer so that a portion of said slurry is trapped in a plurality of pores of said at least one polishing pad, further comprises the step of: automatically flushing said slurry utilizing said sprayer wherein said sprayer comprises a high pressure rinse arm associated with said chemical mechanical polishing device.

3. The method of claim 1 further comprising the step of:

reducing a temperature associated with said chemical mechanical polishing operation while flushing said slurry with said sprayer so that said portion of said slurry is trapped in said plurality of pores of said at least one polishing pad associated with said chemical mechanical polishing operation.

4. The method of claim 1 further comprising the steps of:

configuring said chemical mechanical polishing device to comprises a plurality of polishing elements that include at least one slurry arm that operates in association with said sprayer integrated with at least one pad conditioner, at least one polishing head, at least one rotary platen and at least one loading cup head cross, wherein said sprayer comprises at least one pressure sprayer.

5. The method of claim 4 further comprising the step of:

configuring said chemical mechanical polishing device such that said plurality of polishing elements of said chemical mechanical polishing device are automatically controllable utilizing a robot linked to said chemical mechanical polishing device, wherein said robot is linked to a cassette.

6. The method of claim 1 further comprising the step of:

configuring said chemical mechanical polishing device to include at least one slurry tank connected to at least one pump.

7. The method of claim 6 further comprising the step of:

configuring said chemical mechanical polishing device to include at least one flow meter linked to at least one nozzle and to said at least one pump, such that said at least one flow meter provides a feedback signal to said at least one pump.

8. The method of claim 7 further comprising the step of:

configuring said chemical mechanical polishing device to include at least one controller linked to said at least one flow meter; and initiating a feedback control loop among said at least one controller, said at least one flow meter and said at least one nozzle.

9. The method of claim 8 wherein said at least one controller is integrated with at least one valve.

10. The method of claim 1 further comprising the step of:

performing multiple chemical mechanical polishing operations utilizing at least one diaphragm pump connected to a flow meter and a slurry tank.

11. A system for reducing slurry usage in a chemical mechanical polishing operation utilizing at least one polishing pad thereof, said system comprising:

delivery mechanism for intermittently supplying slurry to a chemical mechanical polishing device; and flushing mechanism comprising a sprayer for flushing said slurry so that a portion of said slurry is trapped in a plurality of pores of said at least one polishing pad associated with said chemical mechanical polishing device, wherein only a minimum amount of said slurry necessary is utilized to perform said chemical mechanical polishing operation, thereby reducing slurry usage and maintaining a consistent slurry removal rate.

12. The system of claim 11 wherein said flushing mechanism further comprises a high pressure rinse arm associated with said chemical mechanical polishing device.

13. The system of claim 11 further comprising:

temperature mechanism for reducing a temperature associated with said chemical mechanical polishing operation while flushing said slurry utilizing said sprayer so that said portion of said slurry is trapped in said plurality of pores of said at least one polishing pad associated with said chemical mechanical polishing operation.

14. The system of claim 11 wherein said chemical mechanical polishing device comprises a plurality of polishing elements that include at least one slurry arm that operates in association with at least one pressure sprayer integrated with at least pad conditioner, at least one polishing head, at least one rotary platen and at least one loading cup head cross.

15. The system of claim 14 further comprising:

a robot for automatically controlling said plurality of polishing elements, wherein said robot is linked to said chemical mechanical polishing device; and wherein said robot is linked to a cassette.

16. The system of claim 11 wherein said chemical mechanical polishing device includes at least one slurry tank connected to at least one pump.

17. The system of claim 16 wherein said chemical mechanical polishing device includes at least one flow meter linked at least one nozzle and to said at least one pump, such that said at least one flow meter provides a feedback signal to said at least one pump.

18. The system of claim 17 wherein said chemical mechanical polishing device includes at least one controller linked to said at least one flow meter, such that a feedback control loop is initiated among said at least one controller, said at least one flow meter and said at least one nozzle, wherein said at least one controller is integrated with at least one valve.

19. The system of claim 11 further comprising at least one diaphragm pump connected to said chemical mechanical polishing device, wherein subsequent multiple chemical mechanical polishing operations are performed utilizing said at least one diaphragm pump.

20. A system for reducing slurry usage in a chemical mechanical polishing operation utilizing at least one polishing pad thereof, said system comprising:

delivery mechanism for intermittently supplying slurry to a chemical mechanical polishing device;

flushing mechanism comprising a sprayer for flushing said slurry so that a portion of said slurry is trapped in a plurality of pores of said at least one polishing pad associated with said chemical mechanical polishing device, wherein only a minimum amount of said slurry necessary is utilized to perform said chemical mechanical polishing operation, thereby reducing slurry usage and maintaining a consistent slurry removal rate;

temperature mechanism for reducing a temperature associated with said chemical mechanical polishing operation while flushing said slurry utilizing said sprayer so that said portion of said slurry is trapped in said plurality of pores of said at least one polishing pad associated with said chemical mechanical polishing operation, wherein said chemical mechanical polishing device comprises a plurality of polishing elements that include at least one slurry arm that operates in association with said sprayer integrated with at least pad conditioner, at least one polishing head, at least one rotary platen and at least one loading cup head cross;

a robot for automatically controlling said plurality of polishing elements, wherein said robot is linked to said chemical mechanical polishing device;

wherein said robot is linked to a cassette; and wherein said at least one controller is integrated with at least one valve.

* * * * *